United States Patent [19]

Youtsey et al.

[11] 3,973,234

[45] Aug. 3, 1976

[54] PRECISION TYPE RESISTOR

[75] Inventors: Karl J. Youtsey, Chicago; William C. Holt, Jr., Prospect Heights; Robert D. Carnahan, Barrington; David H. Spielberg, Schaumburg, all of Ill.

[73] Assignee: Universal Oil Products Company, Des Plaines, Ill.

[22] Filed: Oct. 8, 1974

[21] Appl. No.: 513,026

[52] U.S. Cl. ..... 338/226; 338/214; 338/306; 338/308; 338/315; 338/327

[51] Int. Cl.[2] ..... H01C 1/012

[58] Field of Search ..... 428/295, 368; 338/308, 338/214, 211, 315, 327, 306, 226; 317/101 CC

[56] References Cited

UNITED STATES PATENTS

| | | | |
|---|---|---|---|
| 2,473,183 | 6/1949 | Watson | 338/308 X |
| 2,481,589 | 9/1949 | Hansell | 338/308 X |
| 2,669,646 | 2/1954 | Ford | 338/308 X |
| 2,703,356 | 3/1955 | Buchanan | 338/211 |
| 3,390,452 | 7/1968 | Huang | 338/308 |
| 3,565,683 | 2/1971 | Morelock | 338/308 X |
| 3,818,412 | 6/1974 | Dearduff | 338/314 |
| 3,843,950 | 10/1974 | Schladitz | 338/211 |

FOREIGN PATENTS OR APPLICATIONS

| | | | |
|---|---|---|---|
| 770,175 | 3/1957 | United Kingdom | 338/327 |

*Primary Examiner*—E. A. Goldberg
*Attorney, Agent, or Firm*—James R. Hoatson, Jr.; Philip T. Liggett; William H. Page II

[57] ABSTRACT

Improved forms of electric resistance elements or resistors may be made from semiconducting organic-refractory oxide fibers, as for example drawn alumina fibers which have been subjected to contact with a pyrolyzable organic substance at a temperature above about 400° C. A few, or a large number of the semiconductive fibers, can be used in a group or bundle form to provide a desired resistance for a particular resistor. A preferred form of resistance element will cover the fibers in a quartz tube or other suitable encapsulating material to preclude moisture problems.

4 Claims, 4 Drawing Figures

PRECISION TYPE RESISTOR

The invention relates to a novel form of resistor or resistance heating element and to the procedure for producing such types of elements or devices. More specifically, the invention provides for making precision type resistors from semiconductive organic-refractory oxide fibers, such as calcined fine alumina fibers which are drawn from an alumina sol, with such fibers then being treated at high temperature conditions with a pyrolyzable organic substance to have formed thereon a layer of a carbonaceous pyropolymer.

Since the present invention provides that a relatively few or a relatively large number of the resulting semiconductive fibers can be utilized to form a particular resistor element, it is not difficult to produce precision type, controlled resistance, resistors, thermistors, or other resistance type devices. In other words, in the design of a particular resistor, one or more fibers may be added to a group or bundle of the semiconductive fibers until the resistivity is lowered to a desired point. The bundling of a plurality of fibers will not change the temperature coefficient, but will, of course, change the parallel resistance of the grouping.

It is realized that there are presently many forms of resistors used in the electrical and electronic fields and that some are capable of having controlled, fairly precise, resistance characteristics; however, no known resistors, or resistance type elements, are presently known to be formed from coated fibers in accordance with the present invention in order to readily achieve precise desired characteristics. Typical resistors now in use embody strips formed from depositions of carbon particles, inks, etc., as part of the "thick-film" technology. Also, certain types of resistors may comprise pressed powder mixes which are made from carbon or other semiconductor materials. In any event, many of the presently known types of resistors do not obtain the desired requirements of high resistance values with small size, low noise generation, production repeatability, long term stability, a good temperature range and high temperature coefficient, as well as the capability of withstanding vibration and shock conditions.

It may be considered a principal object of this invention to provide an improved form of resistor element from the utilizatiobn of flexible filaments formed of a refractory oxide that have, in turn, been treated in an atmosphere containing a pyrolyzable organic substance at a temperature above about 400° C. so as to make semiconductive filaments.

It may be considered a further object of the invention to utilize specially produced semiconducting organic-refractory oxide fibers in groups or bundles between terminals so as to have precision high resistance resistors with generally desirable physical and electrical characteristics.

Actually, in a broad aspect, the present invention provides a precision high resistance resistor comprising at least one semiconducting inorganic oxide fiber having been formed from the drawing of a refractory inorganic oxide sol and having a layer of carbonaceous pyropolymer formed from high temperature contact with a pyrolyzable organic substance.

In another aspect, the present invention provides a method for making a precision type resistor element in a manner which comprises the steps of (a) preparing fine flexible fibers from the drawing of a refractory inorganic oxide sol; (b) forming semiconductors of said fibers by forming a layer of a carbonaceous polymer thereon whereby conductivity at room temperature will be from about $10^{-8}$ to about $10^{2}$ inverse ohm-centimeters; and (c) mounting at least one semiconductive fiber, as prepared from step (b), between terminal means to form an electrical resistance element of a desired resistivity.

The flexible refractory inorganic oxide fibers for coating and rendering semiconductive may be made in various ways. For example, such fibers may be made by admixing a refractory inorganic oxide sol and a soluble fiber-forming organic polymer, concentrating the resulting mixture while maintaining it in a liquid phase condition and then drawing the concentrated mixture into fibers. The organic matter in the fibers is burned and the resulting fibers calcined by subjecting time to a temperature of at least about 300°C.

It is preferred to use a soluble polyurethane as the polymer. It is also preferred to effect the drawing of the fibers in an atmosphere characterized by a relative humidity of from about 0% to about 80% and a temperature of from about 25° C. to about 90° C. Preferably, the calcination is effected at a temperature within a range of from about 300° C. to about 1000° C.

The refractory inorganic oxide sols which may be treated in accordance with the method of the present invention include gelable hydrous sols such as alumina sol, zirconia sol, silica sol, magnesia sol, and thoria sol, as well as combinations thereof such as alumina-chromia sols, and alumina-zirconia sols. Those sols resulting from the hydrolysis and concentration of aqueous solutions of one or more appropriate metal salts, such as zirconium acetate, whereby a colloidal dispersion, stable in the remaining liquid, is formed are included.

The alumina sols may be prepared by the hydrolysis of a suitable acid salt of aluminum such as aluminum chloride, aluminum sulfate, aluminum nitrate, or aluminum acetate, in aqueous solution, and treating the solution at conditions to form an acid anion deficient solution or sol. Reduction in the concentration of the acid anion formed by the hydrolysis reaction may be accomplished in any conventional or otherwise convenient manner.

Preferably, the sol is an aluminum chloride sol prepared, for example, by digesting aluminum pellets or slugs in aqueous hydrochloric acid and/or aluminum chloride solution. The digestion is usually performed at about reflux temperature. Aluminum chloride sols are preferably prepared to contain aluminum in from about 1:1 to about 2:1 atomic ratio with the chloride anion.

A soluble, fiber-forming, organic polymer is admixed with the refractory inorganic oxide sol to form a substantially liquid phase reaction mixture. The selected organic polymer must be substantially stable at fiberizing conditions. These conditions include a temperature of from about 5° C. to about 90° C. The soluble, fiber-forming, organic polymers may include the modified natural products prepared as water-soluble derivatives of naturally occurring, fiber-forming, organic polymers or resins. Thus, the soluble, fiber-forming, organic polymer may be a starch derivative such as starch acetate, hydroxyethyl starch, or amine starches. Or, the polymer may be a soluble cellulose derivative, as for example, the alkyl and hydroxyalkyl cellulose derivatives like methylcellulose, ethylcellulose, ethyl methylcellulose, hydroxyethylcellulose, hydroxyethyl methylcellulose, hydroxypropyl methylcellulose, ethyl hydroxyethylcellulose, and higher homologs thereof, and also water-soluble derivatives such as carboxymethylcellulose, carboxy ethyl hydroxyethylcellulose, and the like. Preferably, the soluble, fiber-forming, organic polymer is a synthetic product such as the soluble polyalcohols, polyacids, polyethers, polyimines and polyamides, derived from a variety of synthetic monomers. Suitable synthetic organic polymers include the soluble polyvinylalcohols, polyurethanes, polyacrylic acid salts, polyacrylamides, polyvinyl methyl ethers, polyvinylpyrrolidones, polyethylene oxides, and the like. Since the organic polymer is expended in the fiber making process, it is desirable to utilize a minimum amount commensurate with a desired fiber product quality. Suitably, the organic polymer may comprise from about 0.5 to about 25 wt. % of the reaction mixture although larger amounts may be used. The inclusion of a soluble, fiber-forming, organic polymer in the refractory inorganic oxide sol imparts an added cohesiveness which enables the sol to be drawn or stretched into longer, finer fibers of an orderly molecular arrangement before the sol sets to a gel. The result upon subsequent calcination is a refractory inorganic oxide fiber of improved strength and flexibility.

The reaction mixture thus prepared is concentrated to a tacky consistency while maintaining a substantially liquid phase. The reaction mixture is suitably reduced to the desired consistency by the evaporation of water therefrom. The water may be removed by simple evaporation upon standing or upon stirring in an open vessel, or preferably by treating in a vacuum evaporator at ambient temperature. A tacky consistency is reached at a viscosity of from about 1 to about 1000 poises. The further evaporation of water and initial gelation of the sol is effected as the concentrated reaction mixture is being drawn into stable fibers in an atmosphere of controlled temperature and humidity.

Fiberizing conditions relate principally to the temperature and humidity of the environment in which the fibers are formed. Because of the relatively large surface area of the fibers, a relatively rapid evaporation of moisture with the formation of a stable fibrous hydrogel is possible, provided that the moisture content of the environment is sufficiently low. If, however, the moisture is too high, the desired rapid evaporation does not occur and the fibrous hydrosol may in effect absorb sufficient moisture to collapse in a formless mass. The fiberizing environment should comprise a relative humidity of less than about 80%, and preferably from about 0% to about 80%. The temperature of the fiberizing environment is somewhat less critical and may be from about 5° to about 90° C., and preferably from about 25° C. to about 90° C. The reaction mixture may be formed into fibers by a slow and constant injection of the concentrated reaction mixture into the atmosphere of controlled humidity and temperature. The injected mixture is drawn into fibers. The fibers thus formed are subjected to a specific heat treatment to yield a porous, flexible product. The reaction mixture may be extruded through a perforated plate containing one or more relatively large orifice openings. In any case, the reaction mixture is preferably drawn or extruded into fibers with a maximum diameter of less than about 20 microns for improved flexibility.

The fibers thus formed are thereafter calcined at a temperature of at least about 300° C., and preferably from about 300° C. to about 1000° C., in an air atmosphere. The organic matter is burned from the fibers and a flexible refractory inorganic oxide product is recovered.

As a basic part of the present invention, fibers such as hereinabove described, are made into semiconductors by having a carbonaceous pyropolymer formed thereon. The formation, however, can be made in different ways. The electrical conductivity of a material must fall into one of three categories: conductors, semiconductors, or insulators. Conductors are those materials generally recognized to have a conductivity greater than about $10^2$ inverse ohm-centimeters, while insulators have a conductivity no greater than about $10^{-10}$ inverse ohm-centimeters. Materials having a conductivity within these limits are considered to be semiconducting materials. The semiconducting material of this invention is designed to supplement existing semiconducting materials having a conductivity of from about $10^{-8}$ to about $10^2$ inverse ohm-centimeters in many applications.

The chemical and electrical alteration of the base or source components in the production of the semiconducting material of this invention may be explained as follows. In a method of producing a semiconducting material as another central aspect of this invention, an organic pyrolyzable substance is cracked, reformed, or polymerized upon contact with the refractory oxide at an elevated temperature. The minimum temperature necessary is about 500° C. where only a refractory oxide is used and about 400° C. where the refractory oxide is preimpregnated with a catalytic metallic substance.

The organic feed yields both volatile and non-volatile products. When the organic pyrolyzable substance is cyclohexane, for example, the major volatile product is usually benzene. Whatever the pyrolyzable substance, the non-volatile products remain on the hot refractory oxide as carbonaceous pyropolymers. The carbon percent of the pyropolymers by weight ranges from less than 9% to greater than 34%. The initial attack of the pyrolyzable substance is with active sites on the alumina surface.

The electrical conductivity of the refractory oxide and condensed pyropolymers is effected in three stages. In the first stage, the surface species of the refractory oxide react with the pyrolzable substance to form acceptor-donor charge transfer complexes. The conductivity of the semiconductor material at this stage will depend on the ionization potential of the donor and the electron affinity of the acceptor, as well as on changes in polarization energy due to electron rearrangements. The conductivity increases markedly over a short period of time (less than 30 seconds) in this first phase of conductivity increases and then increases gradually over longer periods of time.

One aspect of the present invention involves the making of a semiconductor having a conductivity of from about $10^{-8}$ to about $10^2$ inverse ohm-centimeters from a refractory oxide fiber having a surface area of from about 1 to about 500 square meters per gram and from an organic pyrolyzable substance comprising heating said refractory oxide fiber to a temperature of from at least about 500° C. to about 1000° C. while in contact with said organic pyrolyzable substance.

The organic pyrolyazable substances most commonly and preferably used for the purposes of this invention are members of the group consisting of aliphatic hydrocarbons, aliphatic halogen derivatives, aliphatic oxygen derivatives, aliphatic sulfur derivatives, aliphatic nitrogen derivatives, organo-metallic compounds, alicyclic compounds, aromatic compoumds, and heterocyclic compounds. Of the aliphatic hydrocarbons, the more common classes which may be utilized to perform this invention are alkanes, alkenes, alkynes, and alkadienes. Ethane, propane, butane, and pentane are among the alkanes that may be successfully used in the performance of this invention. Similarly, alkenes which suffice include ethene, propene, 1-butene, 2-butene, and 1-pentene. Alkynes which may be successfully used include ethyne, propyne, 1-butyne, 2-butyne, 1-pentyne, and 1-hexyne. 1,3-Butadiene and isopropene are included among the alkadienes which may be utilized.

The aliphatic oxygen derivatives appropriate for use in this invention include the classes of alcohols, ethers, halohydrins and alkene oxides, saturated aldehydes and ketones, unsaturated aldehydes and ketones, ketenes, acids, esters, salts, and carbohydrates. Various alcohols which may be utilized include ethanol, 2-butanol, 1-propanol, glycol (e.g., 1,3-propanediol), and glycerol. Ethers utilized include methyl ether, ethyl ether, and isopropyl ether. Appropriate halohydrins and alkene oxides include ethylene chlorohydrin, propylene chlorohydrin, ethylene oxide, and propylene oxide. Suitable saturated aldehydes and ketones include formaldehyde, acetaldehyde, acetone, and ethyl methyl ketone. Unsaturated aldehydes and ketones which may be used include propenol, trans-2-butenal, and butenone. Ketone has also been successfully used as an organic pyrolyzable substance. Likewise, formic acid, acetic acid, oxalic acid, acrylic acid, chloroethanoic acid, formic anhydride, and formylchloride may also be utilized. Esters such as methyl formate, ethyl formate, and ethyl acetate may also be used. Salts such as sodium formate, potassium acetate, and calcium propionate may be utilized as may a variety of carbohydrates. The broad classification of aliphatic sulfur derivatives may be broken down into the subclasses of alkanethiols, alkylthioalkanes, sulfonic acids, and alkyl sulfates and alkyl metallic sulfates. Suitable among the alkanethiols are ethyl mercaptan and n-propyl mercaptan. Among the alkylthioalkanes usable are the thioethers, alkyl sulfides, methyl sulfide, ethyl sulfide, and methyl propyl sulfide. Ethyl sulfonic acid and n-propyl sulfonic acid are sulfonic acids which also may be successfully used. Ethyl sulfate and sodium laurel sulfate and also appropriate for use.

The broad class of aliphatic nitrogen derivatives may be broken down into the subclasses of nitroalkanes, amides, amines, nitriles, and carbylamines. Nitroethane and 1-nitropropane are exemplary of suitable nitroalkanes while acetamide and propyioamide are among the appropriate amides. Amines such as dimethylamine and ethylmethylamine, nitriles such as acetonitrile and propionitrile, and carbylamines such as ethyl isocyanid may also be used for the organic pyrolyzable substance in this invention. Organo-metallic compounds such as tetraiospropyl titanate, tetrabutyl titanate, and 2-ethylhexyl titanate may also be used.

Particularly appropriate and preferred for use as the organic pyrolyzable substance of this invention are the alicyclic compounds. Foremost among these are cyclohexane and cyclohexene, Aromatic compounds include the subclasses of hydrocarbons, halogen compounds, oxygen derivatives, ethers, aldehydes, ketones, quinones, aromatic acids, aromatic sulfur derivatives, and aromatic nitrogen compounds may also be utilized. Among the many suitable hydrocarbons, benzene, naphthalene, anthracene, and toluene were successfully utilized. Benzyl chloride and benzal chloride are appropriate halogen compounds while phenol, o-cresol, benzyl alcohol, and hydroquinone are among the suitable derivatives. Ethers such as anisole and phenetols and aldehydes, ketones, and quinones, such as benzaldehyde, acetophenone, benzophenone, benzoquinone, and anthraquinone may also be used. Aromatic acids such as benzoic acid, phenylacetic acid, and hydrocinnamic acid may be utilized while the aromatic sulfur derivative of benzene sulfonic acid will also serve successfully. The aromatic nitrogen compounds of nitrobenzene, 1-nitronaphthalene, aminobenzene, and 2-aminotoluene may also be successfully used as the organic pyrolyzable substance of this invention. Among the heterocyclic compounds, five-membered ring compounds such as furan, proline, coumarone, thionaphthene, indole, indigo, and carbazole may be successfully utilized. Six-membered ring compounds, such as pyran, coumarin, and acridine may also be utilized. Carbohydrate derivatives such as sugars, including dextrose, fructose, sucrose, starches, etc., provide still other suitable materials.

As can be seen, an extremely wide latitude can be exercised in the selection of the organic pyrolyzable substance, since virtually any organic material that can be vaporized, decomposed and polymerized on the refractory oxide by heating will suffice.

It has been found that the specific carbon concentration corresponding to a particular conductivity is a function of the pyrolyzable substance used to build the carbonaceous pyropolymer. For example, a carbon concentration of 31.7% in the pyropolymer produced from cyclohexane results in a conductivity of about $4 \times 10^{-3}$ inverse ohm-centimeters, while a carbon concentration of 21.1% in the pyropolymer produced from benzene results in a conductivity of about $4 \times 10^{-2}$ inverse ohm-centimeters. This indicates a difference in the pyropolymer structure as between the pyropolymers produced from different pyrolyzable substances. This difference is due to organic residues not included in the extended, conjugated, double-bond structure. Such a difference indicates that extraneous carbon structures may be eliminated from the pyropolymer by a proper choice of starting materials. One particularly advantageous choice is a mixture of benzene and o-xylene. Demethylation of the xylene to produce the benzyl radical or diradical promotes the formation of large aromatic polynuclear networks without extraneous, non-conjugated network elements by providing a large concentration of nucleation radicals. This results in an organic semiconducting material having a high conductivity with a relatively low carbon concentration. Similar results can be achieved using mixtures of o-xylene and naphthalene, o-xylene and anthracene, and halogenated or dihalogenated benzene and benzene, naphthalene, or anthracene.

The organic material may be brought into contact with the fibers by a dipping operation or by admixture with a carrier gas such as nitrogen or hydrogen which will pass over the fibers. The formation of the carbonaceous pyropolymer layer on the surface of the fibers is effected in a relatively high temperature range from about 400° to about 800° C. and preferably in a range of from about 600° to about 750° C.

Reference to the accompanying drawing and the following description thereof will serve to assist to understand the present invention as well as set forth additional advantageous features thereof.

DESCRIPTION OF THE DRAWING

FIG. 1(*a*) is an enlarged diagrammatic view of a single coated fiber.

Referring now to FIG. 1 of the drawing there is indicated a plurality of fibers 1 held in a parallel grouping between suitable terminals 2 and 2', which, in turn, have lead lines 3 and 3' suitable to connect the resistor into an electrical circuit. As will hereinafter be set forth, the lengths of the fibers, the diameters, number used, etc., will be determined to suit a particular resistor characteristic desired.

Figure 1:
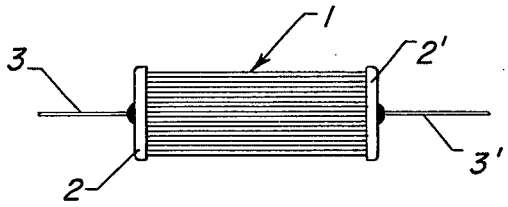
FIG. 1 of the drawing is a diagrammatic elevational view of one form of resistor using a plurality of fibers between end terminals.
Figure 1A:
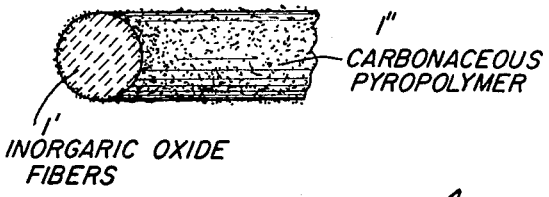

For pictorial purposes, a single coated fiber is shown in FIG. 1(*a*) with the inorganic oxide fiber 1' having a semiconductive composited layer 1 inch of carbonaceous pyropolymer.

The end terminals 2 and 2' may be made of various conductive metals; however, in certain instances they will preferably be made of gold or of an alloy of gold and indium, and the like, in order to provide a resistor device with a low noise level. The lead wires 3 and 3' should also be connected to the respective terminals in a manner to provide good electrical conductivity and effect a low noise level in the resulting resistor. For example, the lead wires may be connected to the terminals by a commercially available silver or gold paste.

Figure 2:
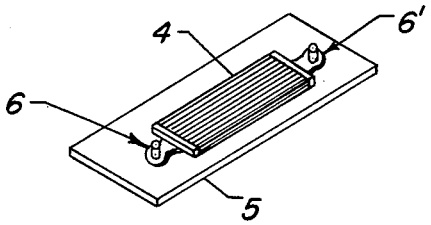
FIG. 2 of the drawing is another diagrammatic view of a resistor indicating the use of a plurality of fine semiconductive fibers in a group being supported on a suitable base member.

In FIG. 2 of the drawing, there is indicated a resistor element where a plurality of semiconductive fibers 4 are cemented or otherwise held to a non-conductive base or support member 5. The latter may be of glass, porcelain, a plastic material, formica, hard-rubber, or of whatever material may be considered appropriate for a particular usage. Terminal means 6 and 6' are also shown connecting to the ends of the group of semiconductive fibers 4 and such terminals are preferably made in a manner and of materials that will minimize the noise level, as described in connection with FIG. 1 of the drawing.

Figure 3:
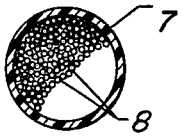
FIG. 3 of the drawing is a diagrammatic cross-sectional view showing the encasement of a group of semiconductive fibers within a nonconductive, sealed covering which may be of glass, resin, or other suitable material.

With respect to FIG. 3 of the drawing, there is shown an enclosure of encapsulation 7 around a group of fibers 8 in order to preclude humidity or moisture problems on the fibers themselves. Without protection, accidental moisture, or even changes in humidity can effect the resistivity characteristics of the coated fibers. The encapsulating material may be a quartz glass tube or any other high resistance material. For example, certain of the "plastic" materials may be used to advantage to provide the desired covering, and such materials could include polyolefins, polyvinylchloride, styrene-butadiene rubber, fluorocarbons, styrene resins, phenolics, polyesters, etc., or multilayer combinations of any of the foregoing.

As heretofore noted, one particular advantage of a resistor type element made of one or more coated fibers, in accordance with the present invention, is the ability to obtain a precision high resistance element. A different number of fibers can be used, different lengths and/or diameters can be used, and different treatments can be used to effect the resistance. In connection with the latter aspect, the heat treatment of the fibers in the presence of the pyrolyzable material for a greater period of time, or at a greater temperature, controls the extent of the desired reaction. Also, a further heat treatment in nitrogen at 300° to 500° C. can reduce the resistance (R) by varying the extent of graphitization, while a heat treatment in oxygen at 400° to 500° C. will increase the R value through oxidation.

The following examples are set forth for illustrative purposes only and are in no way limiting as to the variations or breadth of the present invention.

EXAMPLE I

Where it may be desired to have a resistor with an activation energy of ½ ev and a resistivity of $10^3$ ohm-cm, there can be used a fiber whose activation energy is ½ ev and add fibers to a group or bundle of such fibers until the resistivity is lowered to $10^3$ ohm-cm, i.e. some 60 fibers. If the desired resistivity is $10^5$ ohm-cm, then 100 fibers would be required.

EXAMPLE II

A thin, calcined alumina fiber (approximately 5 microns in diameter and ½ inch long) that had been drawn from an alumina sol in accordance with the procedure outlined hereinbefore, was subjected to treatment with cyclohexane at 600° C. for 20 minutes in a nitrogen atmosphere to be provided with a carbonaceous pyropolymeric layer that made a semiconductor of the fiber. The approximate or "rough resistance" value was found to be $9.6 \times 10''$ ohm.

The element was subsequently subjected to heat treatment in nitrogen at 400° C. for 20 minutes to result in an R value of about $1.00 \times 10''$ ohms.

EXAMPLE III

A thin, calcined alumina fiber, as in Example II, was subjected to a treatment with indene at 900° C. for 20 minutes in a nitrogen atmosphere to be provided with a carbonaceous pyropolymeric layer that made a semiconductor of the fiber. The approximate "rough resistance" value was $2 \times 10^6$ ohms. The element was subsequently subjected to an $0_2$ treatment at 400° C. for 15 minutes in air to increase the resistance to $10^7$ ohms.

EXAMPLE IV

The same conditions as Example III except that the hydrocarbon treatment is performed in a 1% $0_2$-nitrogen gas atmosphere. The resistance of the fiber is then $5 \times 10^8$ ohms instead of $2 \times 10^6$ ohms.

We claim as our invention:

1. A precision high resistance resistor comprising a parallel grouping of a plurality of semiconducting fibers of refractory inorganic oxide having a carbonaceous pyropolymer thereon, said grouping of fibers extending unidirectionally between a pair of spaced terminals to which the end portions of the fibers are connected, and a supporting base of non-conductive material to which said parallel grouping of fibers is attached.

2. The high resistance resistor of claim 1 further characterized in that said inorganic oxide fibers have a surface area of from about 1 to 500 square meters/- gram and said resistor has a conductivity of from about $10^{-8}$ to about $10^{2}$ inverse ohm-centimeters.

3. The resistor unit of claim 1 further characterized in that said terminal means comprise a material providing a low noise level.

4. The high resistance resistor of claim 1 further characterized in that a plurality of the resulting semiconductor fibers are encapsulated in a high resistance, substantially moisture-proof material.

* * * * *